US005580216A

United States Patent [19]

Munsch

[11] Patent Number: 5,580,216

[45] Date of Patent: Dec. 3, 1996

[54] MAGNETIC PUMP

[75] Inventor: Stefan Munsch, Im Staudchen, D56235 Ransbach-Baumbach, Germany

[73] Assignee: Stefan Munsch, Ransbach-Baumbach, Germany

[21] Appl. No.: 488,910

[22] Filed: Jun. 9, 1995

[51] Int. Cl.[6] ..... F04D 29/02; F04D 29/04

[52] U.S. Cl. ..... 415/122.1; 415/200; 415/216.1; 415/217.1; 415/229; 417/420; 417/423.12; 416/241 A

[58] Field of Search ..... 415/110, 111, 415/122.1, 200, 216.1, 217.1, 229–231; 416/204 R, 241 A; 417/420, 423.12

[56] References Cited

U.S. PATENT DOCUMENTS

| | | | |
|---|---|---|---|
| 3,969,043 | 7/1976 | Bright et al. | 417/423.12 |
| 4,120,618 | 10/1978 | Klaus | 417/420 |
| 4,637,750 | 1/1987 | Ward | 416/187 |
| 4,850,818 | 7/1989 | Kotera | 417/420 |
| 4,915,589 | 4/1990 | Gessler et al. | 416/241 B |
| 5,066,200 | 11/1991 | Ooka | 417/420 |

OTHER PUBLICATIONS

D. Gebhard, "Hermetisch dichte Chemie–Kreisel–Pumpen in Kunststoffausführung", *Weitere Informationen cav–47* Sep. 1982, pp. 58–59.

Ahlfeldt, "Wirksame Schutzeinrichtungen", *Weitere Informationen cav–67,* Apr. 1993, pp. 84, 86.

*Primary Examiner*—Edward K. Look
*Assistant Examiner*—Christopher Verdier
*Attorney, Agent, or Firm*—Hill, Steadman & Simpson

[57] ABSTRACT

A magnetic pump is provided which is especially useful for pumping corrosive agents, having simplified components made of a hard ceramic, preferably silicon carbide, which form ceramic-on-ceramic axial and radial bearing surfaces. The pump has an impeller and magnetic rotor, each being mounted on an opposite end of a ceramic shaft by a respective ceramic bush. The shaft rides in ceramic first and second plain bearing bushes, each of which forms a radial bearing surface and an axial bearing journal end face. The ceramic impeller bush is secured to the shaft by a form fit and provides an axial bearing surface against the first bearing bush end face. Similarly, the ceramic rotor bush is secured to the shaft by a form fit and forms an axial bearing surface against the end face of the second plain bush.

8 Claims, 1 Drawing Sheet

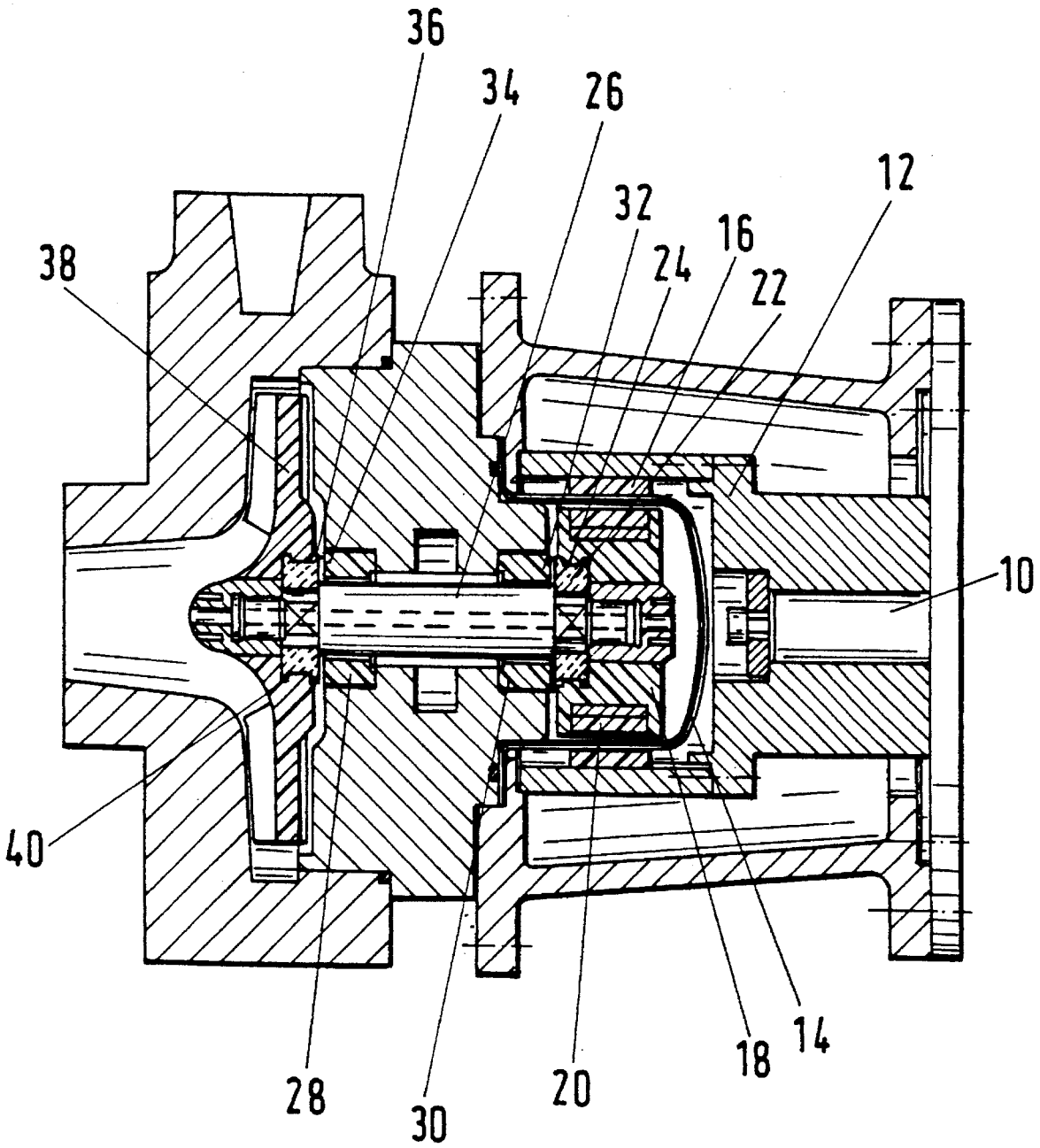
36
34
26
32
24
16
22
12
38
10
40
28
30
20
18
14

MAGNETIC PUMP

BACKGROUND OF THE INVENTION

The present invention generally relates to magnetically-driven pumps. More particularly, the present invention relates to pumps adapted for pumping highly corrosive liquids.

Pumps for corrosive agents are especially employed in the chemical industry. In such pumps wherein a magnetic rotor is employed, it is necessary to bear the rotatory unit (composed of the magnetic rotor, the pump shaft and the impeller) both radially as well as axially in a pump housing.

Previously, in magnetic pumps for highly corrosive agents, it has been conventional to manufacture the pump shaft of steel with a plastic cladding for protection against the aggressive agents. The impeller and magnetic rotor also typically have injected clad metal bushes for transmitting the torque. These must be sealed from the aggressive agents with seal elements in an involved way.

The German periodical CAV, September 1982, pages 58 and 59, discloses a magnetic pump wherein a pump shaft is made of metal and is seated in plain bearing bushes via a hard ceramic sleeve. An impeller bush and a magnetic rotor bush of hard ceramic have only an axial bearing function and contribute nothing to the transmission of torque between the pump shaft and the magnetic rotor or, respectively, impeller. On the contrary, a corresponding, torsional connection of the metal parts of the magnetic rotor, pump shaft and impeller is provided with respect thereto. The corresponding metal parts must be reliably protected by appropriate seals against the aggressive agents to be pumped, resulting in a considerable plurality of required component parts.

The German periodical CAV, April 1993, pages 64 and 86, discloses a pump having a magnetic clutch wherein pump shaft is composed entirely of ceramic. Non-ceramic elements are also required here for the transmission of the torque between magnetic rotor, pump shaft and impeller.

Therefore, an object of the present invention is to provide an improved magnetic pump having a simple structure.

Another object of the present invention is to provide a .magnetic pump having improved resistance to corrosion from aggressive agents.

SUMMARY OF THE INVENTION

The invention is based on the surprising observation that, with a simple structure, a magnetic pump is provided having noticeably improved corrosion resistance. To this end, in an embodiment, the pump shaft, the impeller bush and the magnetic rotor bush are fabricated of hard ceramic, preferably of silicon carbide. The design is implemented such that plain bearing bushes, likewise made of silicon carbide, together with the impeller bush and the magnetic rotor bush simultaneously satisfy the function of the axial bearing for the pump shaft.

More specifically, in an embodiment, a pump is provided having a pump housing and an impeller with an outer surface of plastic corrosion-resistant material. The impeller is arranged in a pumping cavity for generating a flow from an inlet to an outlet. The pump also includes a rotatable shaft made of ceramic material and a magnetic rotor magnetically couplable to a drive rotor. Furthermore, first and second plain bearing bushes are secured to the pump housing, each providing a radial bearing surface rotatably supporting the shaft. The first plain bearing bush forms a journal end face axially facing the impeller, and the second plain bearing bush forms a journal end face facing the magnetic rotor. The first and second plain bearing bushes are made of ceramic material. A ceramic impeller bush is secured to the impeller and is secured to an end of the shaft. The impeller bush forms an axial bearing surface facing the end face of the first plain bearing bush. A ceramic rotor bush is secured to the magnetic rotor and secured to an end of the shaft opposite the impeller. The rotor bush forms an axial bearing surface facing the end face of the second plain bearing bush.

In an embodiment, the shaft, plain bearing bushes, impeller bush and rotor bush are made of silicon carbide.

In an embodiment, the impeller has a plastic outer surface.

In an embodiment, the pump housing has a plastic inner surface.

In an embodiment, the magnetic rotor has a plastic outer surface.

In an embodiment, the impeller bush is shaped to cooperatively receive the end of the shaft with a press fit. Also, in an embodiment, the rotor bush is shaped to cooperatively receive the end of the shaft with a press fit.

In an embodiment, the magnetic rotor is covered by a cup-shaped plastic housing which is disposed on the inner circumference of a magnetic rim of the drive rotor.

A resulting advantage is that no metal surfaces are exposed to the corrosive agents to be pumped and, thus, failure of the pump due to corrosion is practically impossible. The simplicity of the design compared to traditional solutions is likewise striking.

An exemplary embodiment of the invention shall be set forth in detail below with reference to the drawing. Additional features and advantages of the present invention are described in, and will be apparent from the detailed description of the presently preferred embodiments and from the drawing.

BRIEF DESCRIPTION OF THE DRAWING

The drawing, which comprises a single FIGURE, illustrates an axial longitudinal section through an exemplary embodiment of a magnetic pump according to the invention.

DETAILED DESCRIPTION OF THE PRESENTLY PREFERRED EMBODIMENTS

As the FIGURE shows, the magnetic pump of the invention, in an exemplary embodiment, has a drive rotor 12 seated on a motor journal 10 provided with a drive motor (not shown). The drive rotor 12 carries a drive live magnetic rim 16 arranged at the outer circumference of a split pot or divided, cup-shaped housing 14 made of plastic material. A magnetic rotor 18 is rotatably seated inside of the plastic housing 14, and a magnetic rim 20 of the magnetic rotor 18 is magnetically coupled through the wall of the plastic housing 14 to the drive magnetic rim 16 of the drive rotor 12. The magnetic rotor 18 preferably has an outer surface of corrosion-resistant plastic.

A magnetic rotor bush 22 of silicon carbide forms a free, annular axial bearing surface 24 lying in a face end of the magnetic rotor 18 (facing left in the FIGURE). The magnetic rotor bush 22 is secured to and torsionally integrated into the plastic compound of the magnetic rotor 18. The magnetic rotor bush 22 is connected to a pump shaft 26, which is also made of a hard ceramic such as silicon carbide. In an embodiment, the connection is a press fit between a polygonally-shaped end of the shaft 26 into a cooperatively shaped hole in the magnetic motor bush 22. This form fit via the polygonal profile allows a faultless torque transmission.

An impeller bush 36, which is cast into the plastic compound of an impeller 38, is torsionally connected to the end of the pump shaft 26 facing away from the magnetic rotor 18, being connected thereto in a suitable way via a polygonal profile. The impeller bush 36 is likewise composed of silicon carbide.

The pump shaft 26 is rotatably seated in first and second plain bearing bushes 28 and 30, respectively, that are arranged such in the pump housing that each respectively form an annular exposed end journal bearing face 32 and 34. The first plain bearing bush 28 is disposed near the impeller and the second plain bearing bush 30 is disposed near the magnetic rotor 18. The first and second plain bearing bushes 28 and 30 are rigidly secured to the pump housing.

The impeller bush 36 forms an annular axial bearing surface 40 that faces toward the end journal bearing face 34 of the first plain bearing bush 28. Also, the magnetic rotor bush 22 is preferably formed of silicon carbide and forms an annular axial bearing surface 24 which faces the end journal bearing face 32 of the second plain bearing bush 30.

Due to the interaction of the end journal bearing faces 32, 34 of the plain bearing bushes 30, 28 with the respective axial bearing surfaces 24, 40 of the magnetic rotor bush 22 and the impeller bush 36, the need is eliminated for standard axial bearings, which are standard in the prior art. Particularly, the pump shaft 26 is axially borne on a basis of silicon-carbide-on-silicon-carbide by mere contact of the aforementioned axial bearing surfaces 24, 40 with the aforementioned end journal bearing faces 32, 34. Radial bearing of the pump shaft 26 is also assured by a pure silicon-carbide-on-silicon-carbide contact, namely between the pump shaft 26 itself and the plain bearing bushes 28 and 30, so that all bearing functions are accomplished by corrosion-resistant and maintenance-free silicon-carbide-on-silicon-carbide contacts.

The interior of the pump housing, the impeller 38 and the magnetic rotor 18 are all composed of, or surface-coated with, corrosion-resistant plastic material. Therefore, only surfaces composed of silicon carbide or of plastic can come into contact with the aggressive agents to be pumped. High dependability derives as a result thereof.

It should be understood that various changes and modifications to the presently preferred embodiments will be apparent to those skilled in the art. Such changes and modifications may be made without departing from the spirit and scope of the present invention and without diminishing its attendant advantages. Therefore, the appended claims are intended to cover such changes and modifications.

What is claimed is:

1. A pump comprising:

a pump housing;

an impeller having an outer surface of corrosion-resistant material;

a rotatable shaft made of ceramic material;

a magnetic rotor magnetically couplable to a drive rotor; and a bearing arrangement consisting of:

first and second plain bearing bushes secured to the pump housing, each providing a radial bearing surface rotatably supporting the shaft, the first plain bearing bush forming a journal end face for axially bearing against the impeller, the second plain bearing bush forming a journal end face for axially bearing against the magnetic rotor, the first and second plain bearing bushes being made of ceramic material;

a ceramic impeller bush secured to the impeller and secured to an end of the shaft, the impeller bush forming an axial bearing surface facing the end face of the first plain bearing bush; and a ceramic rotor bush secured to the magnetic rotor and secured to another end of the shaft, the rotor bush forming an axial bearing surface facing the end face of the second plain bearing bush.

2. The pump according to claim 1 wherein the shaft, plain bearing bushes, impeller bush and rotor bush are made of silicon carbide.

3. The pump according to claim 1 wherein the pump housing has a plastic surface.

4. The pump according to claim 1 wherein the magnetic rotor has a plastic outer surface.

5. The pump according to claim 1 wherein the impeller bush is shaped to cooperatively receive the end of the shaft with a press fit.

6. The pump according to claim 1 wherein the rotor bush is shaped to cooperatively receive the end of the shaft with a press fit.

7. A pump comprising:

a motor-driven drive rotor having a magnetic rim;

a magnetic rotor;

plastic cup-shaped housing covering the magnetic rotor and being disposed within a circumference of the rim, the magnetic rotor being selectively magnetically coupled with the drive rotor for rotation therewith;

ceramic pump shaft having one end that is torsionally connected to the magnetic rotor and another end torsionally connected to an impeller; and bearing arrangement consisting of:

first and second ceramic plain bearing bushes in which said pump shaft is radially and axially seated in a back pump part, the first plain bearing bush being disposed near the impeller and forming a first exposed end journal bearing face for axially bearing against the impeller, the second plain bearing bush being disposed near the magnetic rotor and forming a second exposed end journal bearing face for axially bearing against the magnetic rotor;

a ceramic impeller bush including an exposed, first axial bearing surface facing toward the first end journal bearing face being connected to the impeller, the impeller bush being secured against rotational movement relative to the impeller;

a ceramic rotor bush including an exposed, second axial bearing surface facing toward the second end journal bearing face being connected to the magnetic rotor, the magnetic rotor bush being is secured against rotational movement relative to the magnetic rotor;

whereby the cup-shaped housing, the impeller and of the magnetic rotor have plastic surfaces toward the inside of the pump, wherein the pump shaft is torsionally connected to the impeller bush and to the magnetic rotor bush with a form fit.

8. The magnetic pump according to claim 1, wherein the ceramic is silicon carbide.

* * * * *